US005922139A

United States Patent [19]

Gilbert

[11] Patent Number: 5,922,139

[45] Date of Patent: Jul. 13, 1999

[54] RAKE FOR CLEANING THE TEETH OF CARPET STRETCHERS

[76] Inventor: James Gilbert, 2831 Gallows Rd., Falls Church, Va. 22042

[21] Appl. No.: 08/804,152

[22] Filed: Feb. 20, 1997

[51] Int. Cl.[6] ..... B08B 7/00

[52] U.S. Cl. ..... 134/6; 15/142

[58] Field of Search ..... 134/6, 42; 15/142

[56] References Cited

U.S. PATENT DOCUMENTS

| | | | |
|---|---|---|---|
| 339,137 | 4/1886 | Brookbank . | |
| 939,290 | 11/1909 | Myers . | |
| 1,280,821 | 10/1918 | O'Leary . | |
| 1,689,209 | 10/1928 | Majewski . | |
| 2,084,603 | 6/1937 | True . | |
| 2,230,610 | 2/1941 | Solomon . | |
| 2,564,721 | 8/1951 | Raya . | |
| 2,856,622 | 10/1958 | Jacobsen . | |
| 2,857,607 | 10/1958 | South | 15/104 |
| 3,170,182 | 2/1965 | Burian . | |
| 3,744,082 | 7/1973 | Marshall | 15/402 |
| 3,913,169 | 10/1975 | Seymour | 15/369 |
| 3,999,244 | 12/1976 | Brickley | 15/142 |
| 4,042,995 | 8/1977 | Varon | 15/142 |
| 4,129,326 | 12/1978 | Weck, III | 294/8.6 |
| 4,627,653 | 12/1986 | Koroyasu | 294/8.6 |
| 5,129,696 | 7/1992 | Underwood | 294/8.6 |
| 5,364,143 | 11/1994 | Grady | 294/8.6 |
| 5,484,136 | 1/1996 | Lopes et al. | 254/200 |

FOREIGN PATENT DOCUMENTS 1186445 4/1970 United Kingdom .

*Primary Examiner*—Lyle A. Alexander
*Assistant Examiner*—Alexander Markoff
*Attorney, Agent, or Firm*—Jacobson, Price, Holman & Stern, PLLC

[57] ABSTRACT

A rake is used to clean nap from between teeth of a nap grip located on the underside of a carpet stretcher. The rake generally has an elongated handle connected to a rake head. Multiple prongs are connected to a leading edge of the rake head. Each prong has a shaft with an end connected to the leading edge of said head and a gradual bend forming a pointed tip substantially perpendicular to the shaft. The prongs are equally spaced to align with alternate spaces of the carpet stretcher gripping element so that the prongs can be drawn along the alternate spaces to remove material from said carpet stretcher gripping element.

9 Claims, 2 Drawing Sheets

RAKE FOR CLEANING THE TEETH OF CARPET STRETCHERS

BACKGROUND OF THE INVENTION

1. Field of the Invention

The present invention relates to a rake for cleaning material from devices having rows of prongs or teeth. More particularly, the present invention relates to a rake for cleaning carpet nap from the teeth of a gripping element used on a carpet stretcher.

2. Description of the Related Art

Carpet stretchers or "kickers" are used to stretch a carpet being affixed to a floor surface in order to tension or stretch the carpet to maintain it in a taut condition and eliminate raised ridges or the formation of upwardly buckled areas in the carpet that otherwise might occur during installation. A gripping element is typically fashioned on the underside of an engaging head of the carpet stretcher and includes slanted or bent teeth or pins which actually grip the carpet. One end of the carpet stretcher is struck by a knee or other device, causing the engaging head to move in a direction that the gripping element pulls the carpet in the same direction.

Gripping elements generally have downwardly extending metal prongs or teeth that engage the carpet. The prongs of the gripping element may be of various sizes that simultaneously engage different portions of the carpet. Extended prongs are used to engage the base of the carpet, while shorter prongs generally engage the nap or pile of the carpet. Both the extended prongs and the shorter prongs are generally slanted or bent to better grip the carpet.

Gripping elements are configured both integral to the engaging head and as independent plates or inserts that are secured to the engaging head by a fastener. Usually, the teeth of the gripping element are aligned in parallel vertical rows that are typically offset horizontally across. The teeth are also commonly grouped to form multiple sets of teeth. Conventional carpet stretchers and gripping elements are shown, for instance, in U.S. Pat. Nos. 5,129,696 and 4,627,653.

The difficulty with the gripping elements is that they tend to tear pieces of nap from the carpet. The gripping elements also tend to accumulate loose pieces of nap that often accompanies new carpet. Thus, the teeth of the gripping element become clogged with nap, especially shorter teeth that usually engage the nap of the carpet. As the nap builds between the teeth, the gripping element is unable to fully engage the nap of the carpet.

The clogged teeth cause the gripping element to quickly lose the ability to firmly and easily engage the carpet. The carpet stretcher becomes less effective, and more prone to slipping. The clogged gripping element requires more effort to stretch the carpet, and increases risk of injury to the carpet layer.

Cleaning the nap from between the teeth is exceedingly troublesome since the teeth are sharp and closely spaced together. It is especially difficult to reach nap that is buried deep between the teeth. Consequently, a great deal of time and effort would be required to clean nap from a clogged gripping element and in replacing clogged inserts.

In order to avoid the problem of clogged teeth, the gripping element has been configured with plates having downward projections, instead of teeth, such as shown in Great Britain Patent No. 1 186 445 to Cowan. Cowan, therefore, attempts to avoid nap from becoming clogged in the gripping element. However, Cowan does not resolve the problem of cleaning nap from an already clogged gripping element.

Devices are generally known for cleaning between rows of upright projections, and especially for cleaning hair out of combs and brushes. Several cleaning devices are shown, for instance, in U.S. Pat. Nos. 2,857,607, 2,564,721, 1,280,821, and 339,137. However, none of these cleaners are adaptable for use in cleaning the gripping element of a carpet stretcher.

SUMMARY OF THE INVENTION

Accordingly, it is an object of the present invention to provide an implement for cleaning material from devices having rows of prongs or teeth.

It is a further object of the invention to provide a rake that is sturdy and capable of cleaning carpet nap from the teeth of a gripping element used on a carpet stretcher.

It is another object of the invention to provide a quick and easy method for removing nap stuck in a gripping element of a carpet stretcher.

It is yet another object of the invention to provide a cleaning rake that is not complex in structure and which can be manufactured at low cost but yet efficiently removes nap from the teeth of a carpet stretcher.

In accordance with these objectives, a rake is provided for cleaning nap from between teeth of a nap grip located on the underside of a carpet stretcher. The rake generally has an elongated handle connected to a rake head. Multiple prongs are connected to a leading edge of the rake head. Each prong has a shaft with an end connected to the leading edge of said head and a gradual bend forming a pointed tip substantially perpendicular to the shaft. The prongs are equally spaced to align with alternate spaces of the carpet stretcher gripping element so that the prongs can be drawn along the alternate spaces to remove material from said carpet stretcher gripping element.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
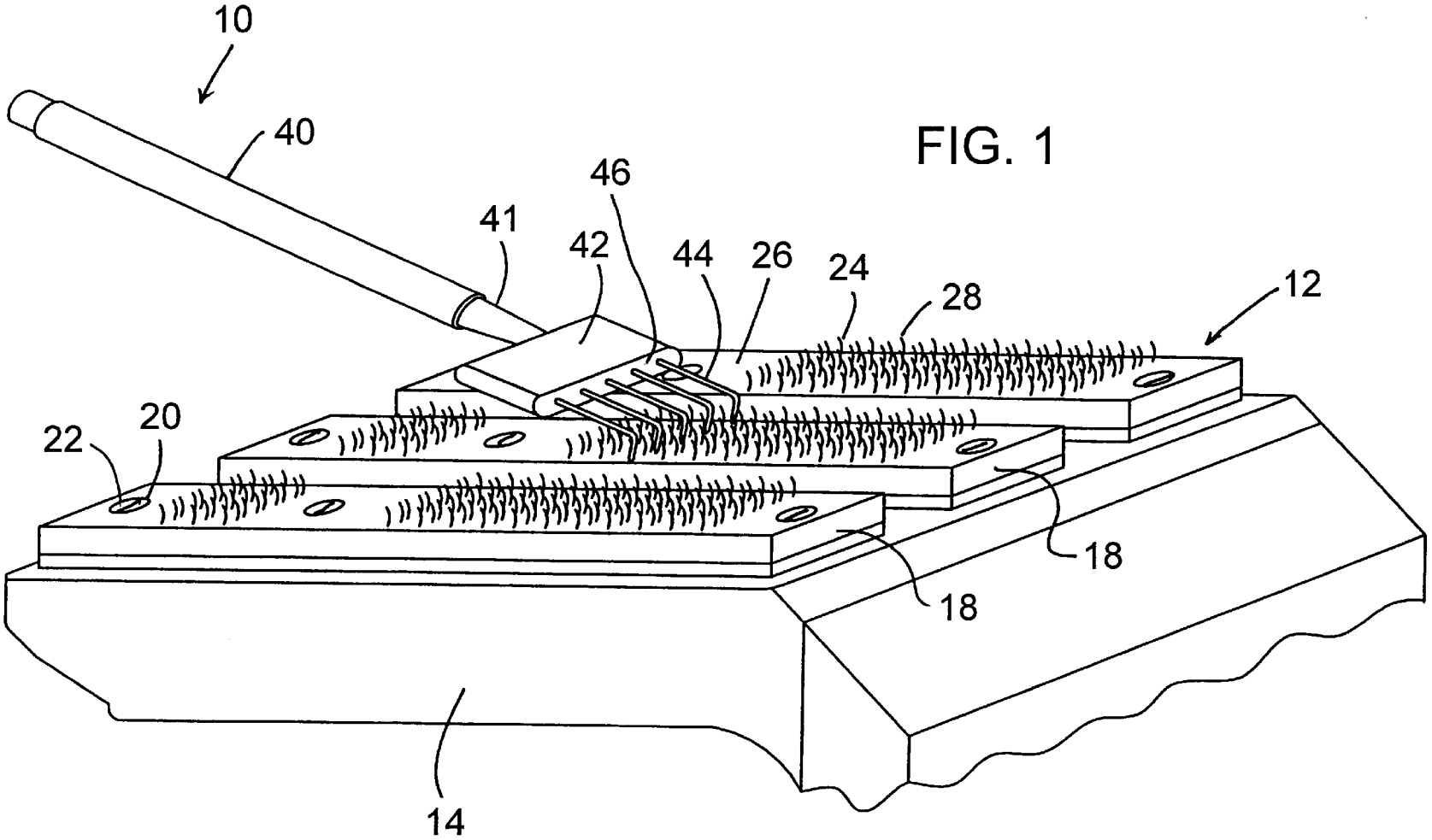
FIG. 1 is a perspective view of the rake used to clean nap grip inserts located on the underside of a carpet stretcher.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Now turning to the drawings, FIG. 1 shows a cleaner or rake 10 for use with a gripper element 12 located on the underside of the head 14 of an inverted carpet stretcher. In the preferred embodiment, the gripper element 12 includes a plurality of parallel inserts 18 that engage the nap or pile of a carpet (not shown). The nap-grip inserts 18 are removably secured to the head 14 of the carpet stretcher by fasteners or screws 22 extending through holes 20 with screw heads being recessed into the surface of the insert to avoid protrusions on the bottom surface of the insert. Preferably, the underside of the head 14 of the carpet stretcher is fitted with three inserts 18.

The inserts 18 are shown protruding out from the underside of the carpet stretcher head 14. However, the inserts 18 may also be located in a recess of carpet stretcher head 14, so that the base plate 26 of the insert 18 is flush with the surface of the underside of carpet stretcher head 14.

The nap-grip inserts 18 have pins or teeth 24 that extend downward from the base plate 26 when the carpet stretcher is in use to engage the carpet nap or pile. The teeth 24 preferably have a rectangular cross-section, as better shown in FIG. 3, though they may be of any suitable configuration. The teeth 24 generally have a straight bottom portion that extends perpendicular to the base of insert 18. The teeth 24 are bent at the middle and the tips 28 have an edge that better grips the carpet nap.

The nap-grip cleaning rake 10 generally has a handle 40 and a head 42 from which prongs 44 extend. The handle 40 is preferably cylindrical, and has a tapered neck 41 toward head 42 so as to be ergonomic and easy to grip. The head 42 is preferably rectangular in shape.

Figure 3:
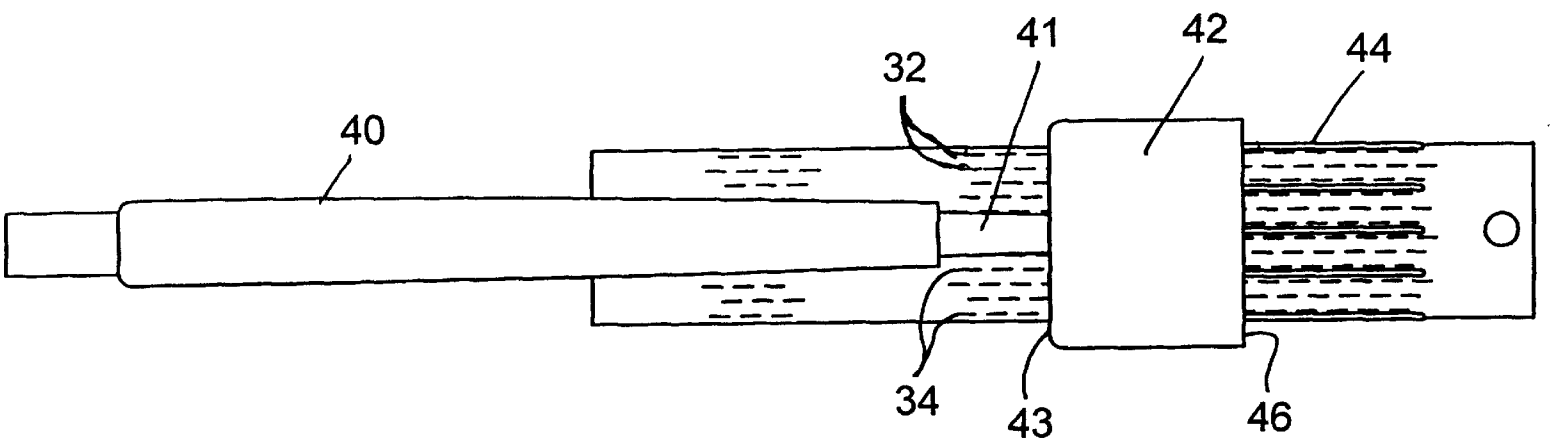
FIG. 3 is a top view of the rake and nap grip insert illustrating the association of the rake prongs with the teeth on a nap grip insert.

The handle 40 connects centrally to the rear edge 43 of head 42 (as best shown in FIG. 3). The handle 40 is preferably integral with the head 42. However, the handle 40 may be connected to head 42 by any suitable fastener, such as a screw (not shown) that is embedded in the end of handle 40 and which screws into head 42.

Figure 2:
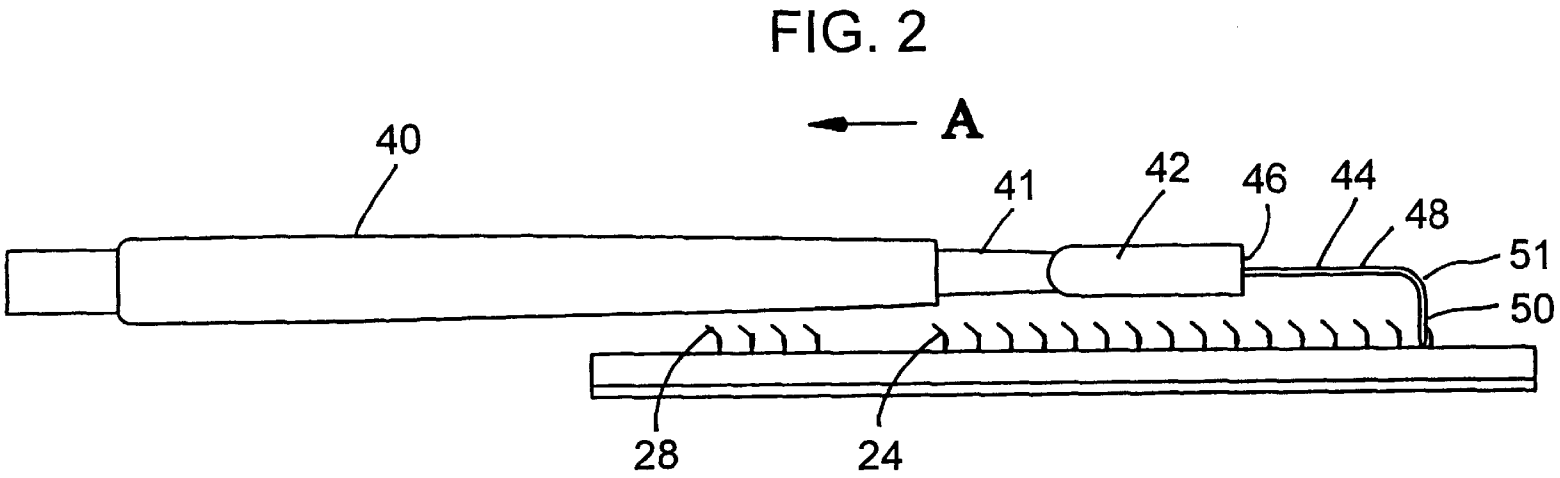
FIG. 2 is a side view of the rake and nap grip insert illustrating the relationship of the tips of the rake prongs with the teeth and base plate of a nap gripping insert.

Turning to FIGS. 2 and 3, prongs 44 have a shaft 48 at one end that leads into tips 50 at an opposite end. The shaft 48 of each prong 44 is secured to the leading face or edge 46 of head 42. Preferably, the prongs 44 are affixed to the head 42 by first drilling holes (not shown) in the leading edge 46 of head 42. The holes are designed to be slightly smaller than the diameter of prongs 44. The prongs 44 are then forcibly inserted into the holes to form a friction fit. Adhesive may be applied to the inside the holes prior to insertion of the prongs 44 to better secure prongs 44 to head 42.

Prior to inserting prong 44 into head 42, the prong 44 is bent at 51 to form a tip 50 that is contiguous with and substantially perpendicular to the shaft 48. The tips 50 are pointed so as to be more easily directed between the transversely spaced longitudinal columns 32 of teeth 24 on insert 18. In addition, the pointed tips 50 permit the prongs 44 to better pass under any nap clogging teeth 24.

Now turning to FIG. 3, the operation of the rake 10 will be described in further detail. The rake 10 is positioned over insert 18 so that the prongs 44 are substantially aligned with the space between columns 32 at one end of the insert 18. The rake 10 is then drawn to the other end of the insert 18, preferably while inclined. As the rake 10 is drawn, the tips 50 on prongs 44 will slide along the surface of the base plate 26 of the insert 18 and lift and remove any nap that is stuck between teeth 24, on the surface of the teeth 24, or otherwise clogging insert 18. The rake 10 is preferably drawn in the slanted or bent direction of the insert teeth, as shown by arrow A of FIG. 2.

The dislodged nap accumulates on the tips 50 and shaft 48 of the prongs 44. The user may then easily clean the nap from the prongs 44 by sliding the nap off the shaft 48 and over the tips 50. As best shown in FIG. 2, the tip 50 has a gradual bend 51 so that accumulated nap can easily travel from tip 50 to shaft 48. The gradual bend 51 further aids cleaning the rake 10 in the reverse direction.

Normally, nap will accumulate on the surface of the teeth 24. Thus, the tips 50 of prongs 44 are designed to reach beneath any nap collected on the surface of the teeth 24, or on the surface of the base plate 26, in order to remove the nap. Moreover, as shown in FIG. 2, the tips 50 of prongs 44 are longer than the teeth 24 so that the prongs 44 can extend through any nap on the surface of the teeth 24 and reach any nap or dirt that is located at the base of teeth 24. In addition, the nap is more easily gathered by prongs 44, yet be retained on the rake 10 by shaft 48. At the same time, the prongs 44 are not excessively long so as to be awkward to use or allow removed nap to fall free of shaft 48.

In the preferred embodiment, the head 42 is about 1⅛ inches across so that five prongs 44 may be located on the leading edge 46 of the head 42 and spaced apart approximately 3/16 of an inch. The standard insert 18, in comparison, is about ¾ of an inch wide, with the columns 32 being 1/16 of an inch apart. In this manner, the prongs 44 engage the space between every third column 32 of teeth 24 and overlap either side of insert 18 during operation.

Further to the preferred embodiment, the handle 40 is 3½ inches long and has a diameter of about ⅜ of an inch. The head 42 is about ⅞ of an inch long and about ⅜ of an inch thick. The prongs 44 roughly have a diameter of 1/16 of an inch. The tips of the prongs 44 are about ⅜ of an inch in length, which is slightly longer than the teeth 24 of insert 18 (which are typically about 3/16 of an inch long), so that the prongs 44 reach the base of insert 18. The shaft 48 of prongs 44 are about ⅝ of an inch in length. The handle 40 and head 42 are constructed of rigid plastic, and the prongs 44 are metal.

As best shown in FIG. 3, the teeth 24 of inserts 18 are aligned in evenly-spaced parallel columns 32 that extend the entire length of the insert 18. In addition, the adjacent columns 32 of teeth 24 are uniformly offset so that the teeth 24 of every third column 32 is aligned to form rows 34. The rows 34 generally extend across the entire width of insert 18. The teeth 24 may be secured to base plate 26 by connecting two teeth 24 together to form a staple that is inserted from the underside of the base plate 26.

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. For example, the cleaner may be used to clean nap from carpet stretchers having extended gripping elements, teeth or pins adapted to engage the base or backing of a carpet on various devices, such as a carpet lifter or other nap-gripping tools. Therefore, it is not desired to limit the invention to the specific examples disclosed or the exact construction and operation shown and described. Rather, all suitable modifications and equivalents may be resorted to, falling within the scope of the invention.

I claim:

1. A method for removing material from a carpet stretcher gripping element having pins arranged in columns with spaces therebetween, the method comprising providing a rake having an elongated handle connected to a head having a leading edge and prongs connected to the leading edge, the prongs being equally spaced to align with alternate spaces located between the columns of the carpet stretcher gripping element, and drawing said rake across said carpet stretcher gripping element such that the prongs move along alternate spaces to remove material from said carpet stretcher gripping element.

2. A method for removing material from a carpet stretcher gripping element having pins arranged in columns with spaces therebetween, the method comprising providing a rake having an elongated body with a front end and prongs connected to the front end, the prongs being arranged to align with spaces located between the columns of pins of the carpet stretcher gripping element, and using said rake to remove material from said carpet stretcher gripping element.

3. The method of claim 1, wherein the prongs have a cross section that is circular.

4. The method of claim 2, wherein the prongs have a cross section that is circular.

5. The method of claim 1, wherein the prongs are substantially longer than the pins.

6. The method of claim 2, wherein the prongs are substantially longer than the pins.

7. The method of claim 1, wherein the head is removably connected to the handle.

8. The method of claim 2, wherein the body has a head that forms the front end, said prongs are connected to the front end of the head.

9. The method of claim 8, wherein the head is removably connected to the elongated body.

* * * * *